US005249547A

United States Patent [19]

Takada et al.

[11] Patent Number: 5,249,547

[45] Date of Patent: Oct. 5, 1993

[54] MANUALLY OPERATED SIZING MACHINE

[75] Inventors: Toshinari Takada, Ako; Masatoshi Wakabayashi, Aioi; Arata Koroyasu, Tatsuno; Yasuaki Matsui, Kakogawa, all of Japan

[73] Assignee: Kyokutosanki Co., Ltd., Tatsuno, Japan

[21] Appl. No.: 993,899

[22] Filed: Dec. 18, 1992

Related U.S. Application Data

[63] Continuation of Ser. No. 676,408, Mar. 28, 1991, abandoned.

[30] Foreign Application Priority Data

Mar. 29, 1990 [JP] Japan ..... 2-33435
May 2, 1990 [JP] Japan ..... 2-47278

[51] Int. Cl.[5] ..... B05C 3/02

[52] U.S. Cl. ..... 118/415; 118/419; 118/DIG. 17

[58] Field of Search ..... 156/524, 575, 527; 118/DIG. 17, 407, 419, 405, 415, 43, 40; 225/40

[56] References Cited

U.S. PATENT DOCUMENTS

| | | | |
|---|---|---|---|
| 834,087 | 10/1906 | Vogt | 118/38 |
| 2,745,376 | 5/1956 | Nowak | 118/40 |
| 3,266,689 | 8/1966 | Hruby | 225/40 |
| 3,496,909 | 2/1970 | Bennett | 118/43 |
| 4,264,403 | 4/1981 | Emmel et al. | 156/527 |
| 4,660,502 | 4/1987 | Scott | 118/415 |

*Primary Examiner*—W. Gary Jones
*Assistant Examiner*—Brenda Lamb
*Attorney, Agent, or Firm*—Armstrong, Westerman, Hattori, McLeland & Naughton

[57] ABSTRACT

A manually operated sizing machine comprising a sheet roll unit, a size container with a sheet pullout port, a separation wall thereof and a clearance at the bottom of said wall, and designed to size a sheet pulled out through the clearance at the bottom of the separation wall.

It is a compact and less expensive machine which permits easy and even sizing on wall paper, floor sheet and various kinds of sheet.

3 Claims, 8 Drawing Sheets

A
B
3
4
5
6
11
12
16
17

MANUALLY OPERATED SIZING MACHINE

This application is a continuation of application Ser. No. 07/676,408 filed Mar. 28, 1991, now abandoned.

FIELD OF THE INVENTION

The present invention relates to a manually operated sizing machine, and more particularly, to a manually operated sizing machine which can be used conveniently for hanging wall paper (cloth) and floor sheet at home.

PRIOR ART

Conventionally, pasting various kinds of wall paper (cloth) has been performed during the finishing step of a building construction. During this operation, manually-operated or automatic sizing machines have been frequently used.

These sizing machines, which operate on the system in which the back face of wall paper is pressed against the sizing roller provided in a size container, and in which the size from the sizing roller is transferred onto the back face of the wall paper, have been all of large-sized for the sizing of wide sheet for field operations.

These conventional sizing machines have been commonly provided with a doctor roller designed to adjust for the amount of size to be transferred to the wall paper. Most of these machines, intended for sizing for commercial use, have been fixed on a wheel-mounted dolly moving about on the floor or carried on supports which are freely foldable.

However, these conventional sizing machines are intended for use at operations at a construction site and the like, and thus they cannot be employed conveniently for household use. Accordingly, when wall paper is to be pasted to change the interior decoration of a room or repair the wall, there has been no choice but to size wall paper with brush and other means. By these procedures, however, it is difficult to apply even coats of adequate amount of size on the paper, and paper pasted does not look good, and there is no place to spread the wall paper. For this reason, the realization of a handy, compact and new sizing machine which can be used conveniently at home and permits even sizing has been wanted.

SUMMARY OF THE INVENTION

An object of the present invention is to provide an easily-operable, compact and less expensive manually operated sizing machine which permits even pasting an adequate amount of the size on wall paper (cloth), floor sheet and other sheet materials.

The manually-operated sizing machine according to the present invention is featured by having a sheet roll unit, a size container with a sheet pullout port, a separation wall thereof and a clearance at the bottom of the wall, and sizing the sheet pulled out through the clearance at the bottom of the wall.

DETAILED DESCRIPTION OF THE INVENTION

Figure 1:
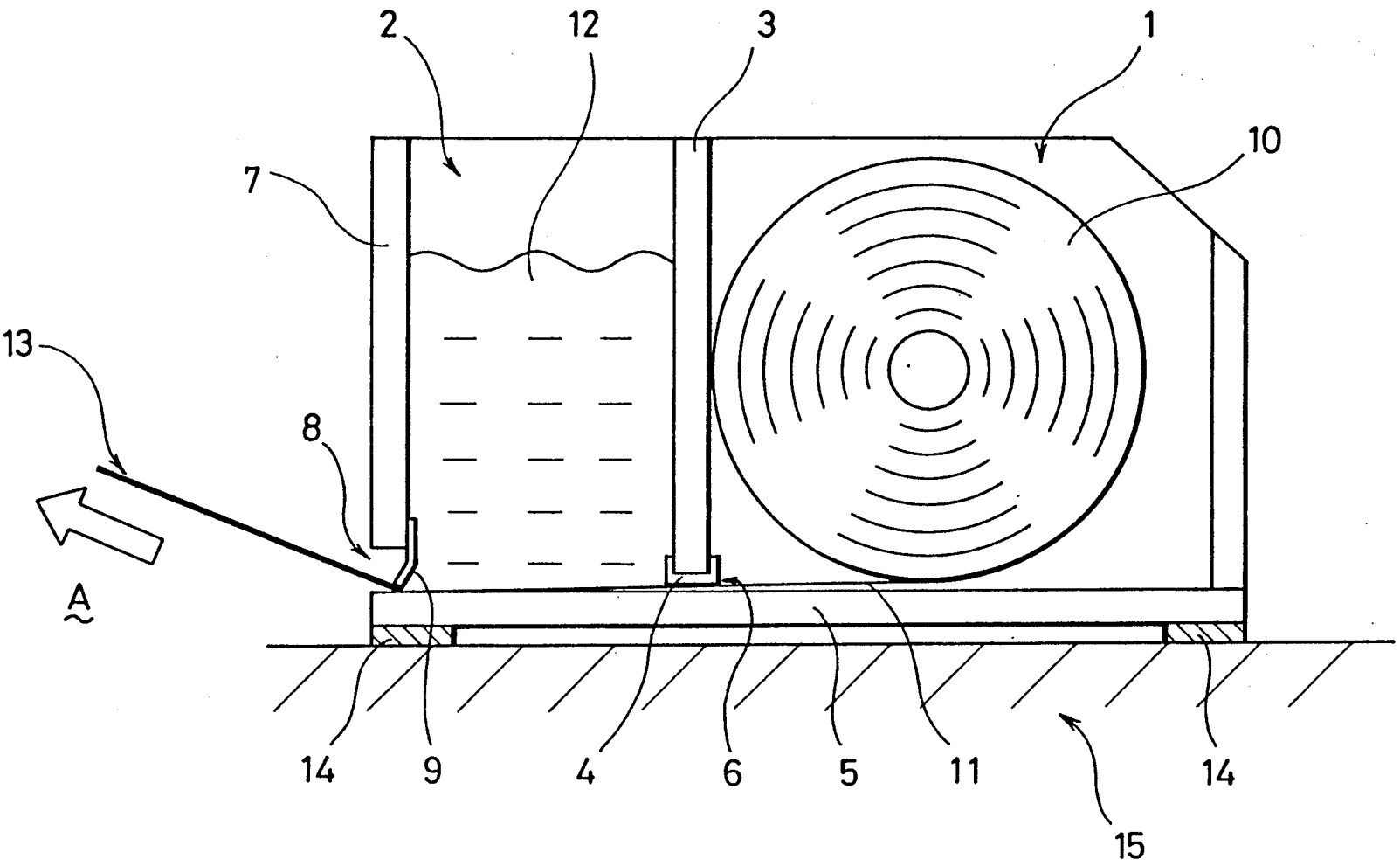
FIG. 1 is a vertical sectional view of one embodiment of the manually operated sizing machine of the present invention.

The manually-operated sizing machine of this invention has a sheet roll unit (1) and a size container (2), as indicated in FIG. 1, with the sheet roll unit (1) and size container (2) separated with a wall (3). The bottom of the wall (3) is provided with a size press (4), with a clearance (6) being provided between the size press (4) and the bottom plate (5). The bottom of an end plate (7) of the size container (2) opposite to the wall (3) is provided with a sheet pullout port (8), with the sheet pullout port (8) provided with a size cutter (9).

In the case where wall paper is sized with a sizing machine with such an arrangement, a wall paper roll (10) is inserted into the sheet roll unit (1), the wall paper (11) pulled out of the wall paper roll (10) is pulled out through the clearance (6) of the bottom of the wall (3) with its back side up and allowed to pass through the size container (2), with the tip pulled out of the pullout port (8).

With the wall paper (11) set in this condition, size (12) is put into the size container (2), the size (12) is caused to adhere to the back face of the wall paper (11), and the wall paper (11) is pulled out of the pullout port (8) in a direction shown with an arrow (A). Doing this gives a sized wall paper (13). There are no special limitations on the length, width and thickness of the wall paper (11), and they can be set to desired dimensions as far as they can be operated within the reach of both hands.

In this example, the bottom plate (5) of the sizing machine is fixed on a work bench (15) or similar equipment with a pressure sensitive adhesive double coating tape (14). This facilitates the pulling out of the sized wall paper (13).

In the sizing machine according to the present invention, prevention of the outflow of size from the size container (2) and the adjustment of the amount of size to be adhered to the wall paper (11) are specially important requirements. In the case of a sizing machine according to the present invention as illustrated in FIG. 1, the size (12) is prevented from flowing and seeping into the sheet roll unit (1) by means of the size press (4), and the size (12) is prevented from flowing out of the pullout port (8) by means of the size cutter (9). The size cutter (9) also adjusts the amount of the size to be adhered on the wall paper (11).

Figure 2:
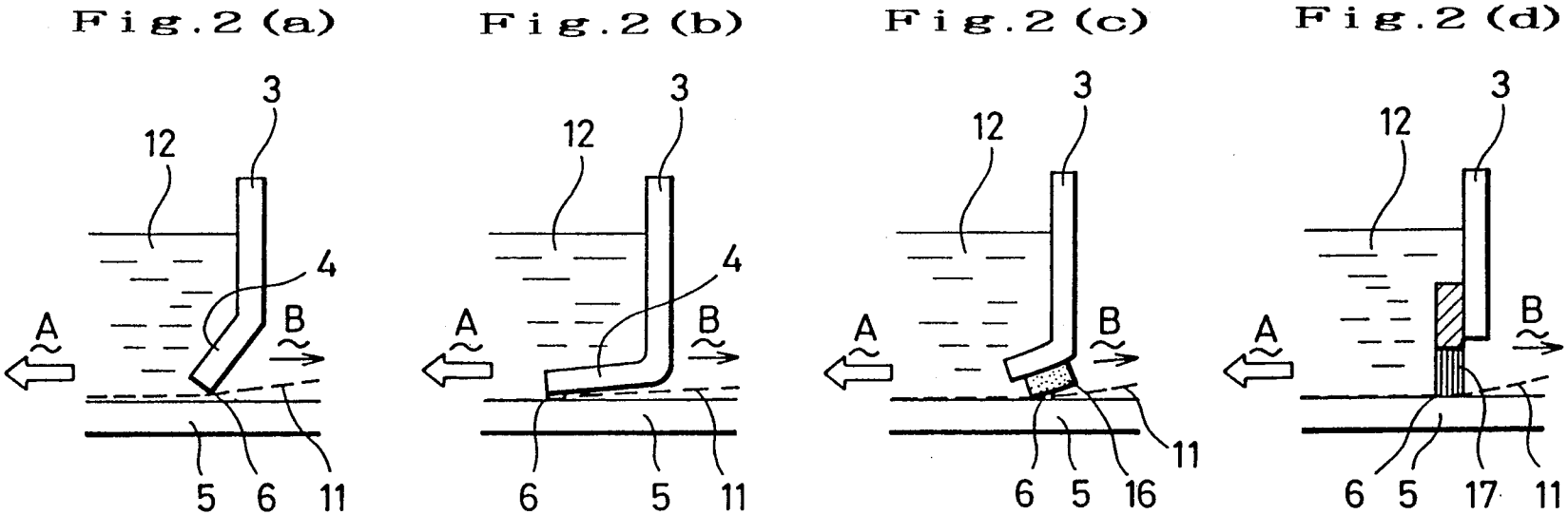
FIGS. 2 (*a*), (*b*), (*c*) and (*d*) are side sectional views, respectively, of various configuration of the size press of the present invention.

FIGS. 2 (*a*), (*b*), (*c*) and (*d*) show examples having a size press different in construction from that of the size press (4) shown in FIG. 1.

The example in FIG. 2 (*a*) employs an elastic material for the separation wall (3) itself, thereby causing the bottom thereof to function as a size press (4). The one in FIG. 2 (*b*) has the bottom of the separation wall (3) extended and folded, while the ones in FIGS. (*c*) and (*d*) are provided with a sponge (16) and a brush, respectively, at the bottom of the separation wall (3). They facilitate smooth movement of the wall paper (11), and improve the sealing performance at the clearance (6), serving to prevent the outflow or seepage of the size (12) in the direction (B).

Figure 3:
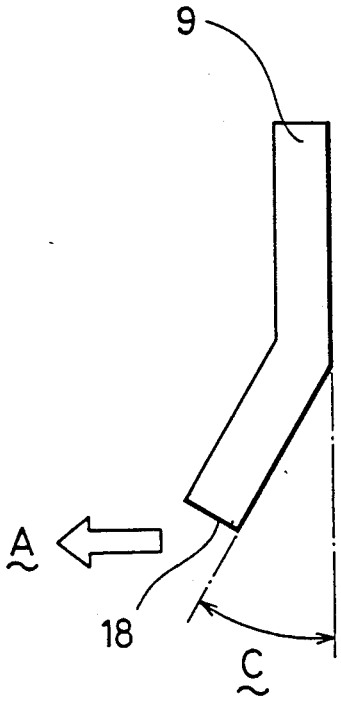
FIGS. 3 (*a*) and (*b*) are side elevation and rear elevation of one example of the size cutter according to the present invention.
Figure 3:
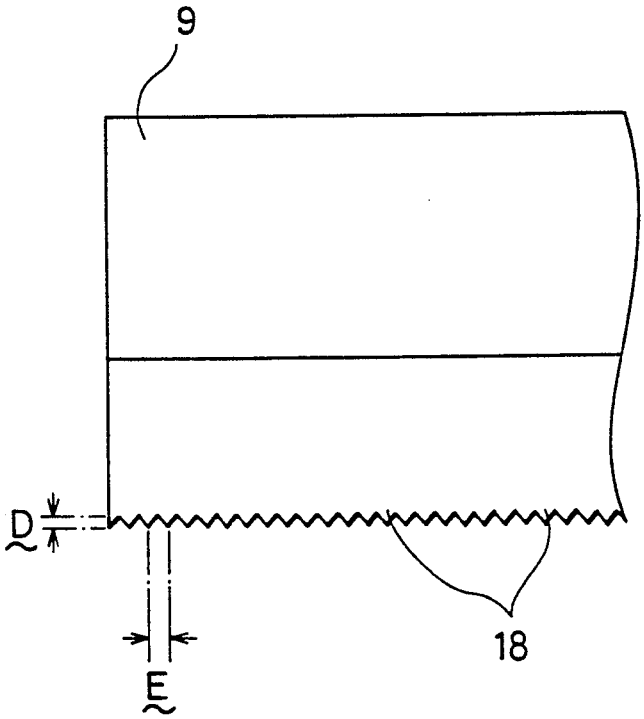

FIGS. 3 (*a*) and (*b*) depict the side surface and back surface of the size cutter (9) as indicated in FIG. 1, respectively.

As illustrated in FIG. 3 (*a*), the size cutter (9) can be folded at a given angle (C) in the direction (A) of pulling out the wall paper, cutting size with a reaction force which occurs during the pullout operation. As indicated in FIG. 3 (*b*), the tip thereof (B) can be shaped like a sawtooth. While the wall paper (11) is passing between the size cutter (9) and the bottom plate (5), the amount of size to be adhered on the back surface of the wall paper (11) can be adjusted depending on such factors as the folding angle (C) of the size cutter (9), the height (D) and pitch (E) of the sawtooth (D) formed on its tip (18).

Figure 4:
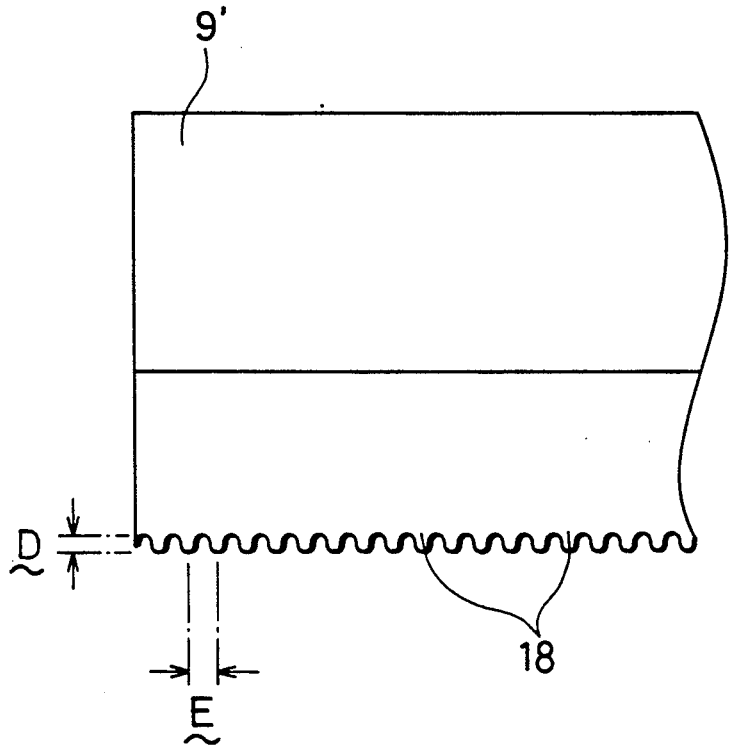
FIG. 4 is a back elevation of another example of the size cutter according to the present invention.

In the manually-operated sizing machine according to the present invention, size cutter (9') whose tip (18) is waveformed can be used as illustrated in FIG. 4. Such size cutter (9') is effective for especially thin wall paper or for material easy to break. Of course, as with the aforestated size cutter (9), it is possible to adjust the amount of size to be adhered depending on the height (D) and pitch (E) of the wave of the tip thereof (18).

By this manually operated sizing machine, the size cutter is removable and the tips thereof are made available in and selectable from various shapes, applying an adequate amount of size on comprehensive kinds of sheet evenly.

Figure 5:
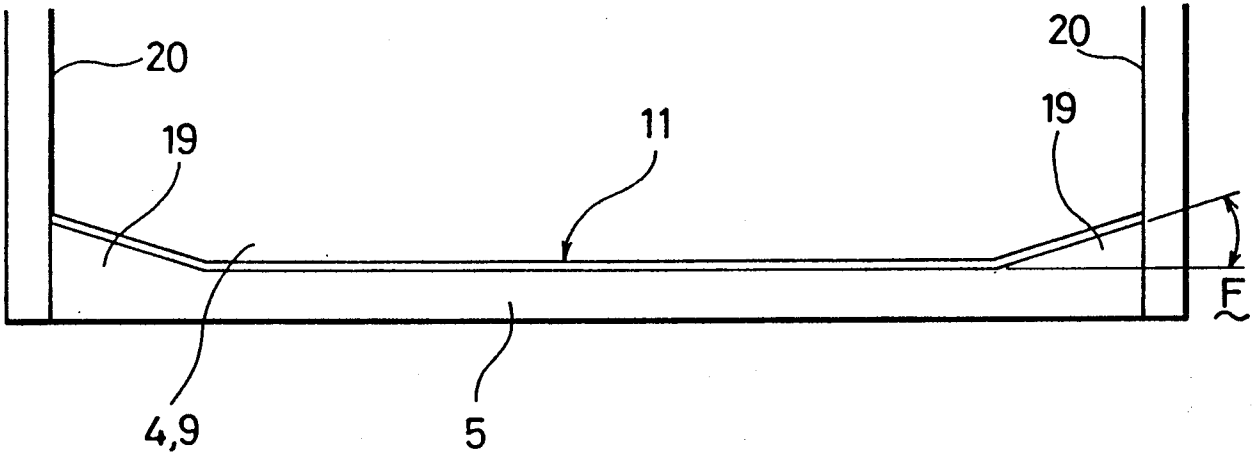
FIG. 5 is a front sectional view of the (manually operated sizing machine) having a bottom plate with inclined end portions at right and left.

As depicted in FIG. 5, to prevent the size (12) from seeping through the side edges of the wall paper (11) into the surface thereof, inclined portions (19) with an angle (E) at both sides of the bottom plate (5) are provided, forming the size press (4) and the size cutter (9) to specified shape corresponding thereto. Additionally, a sponge or other size press may be mounted on the contact surface of the side plates (20) with the wall paper (11).

Normally, viscous size produces no such problem of seepage.

Figure 6:
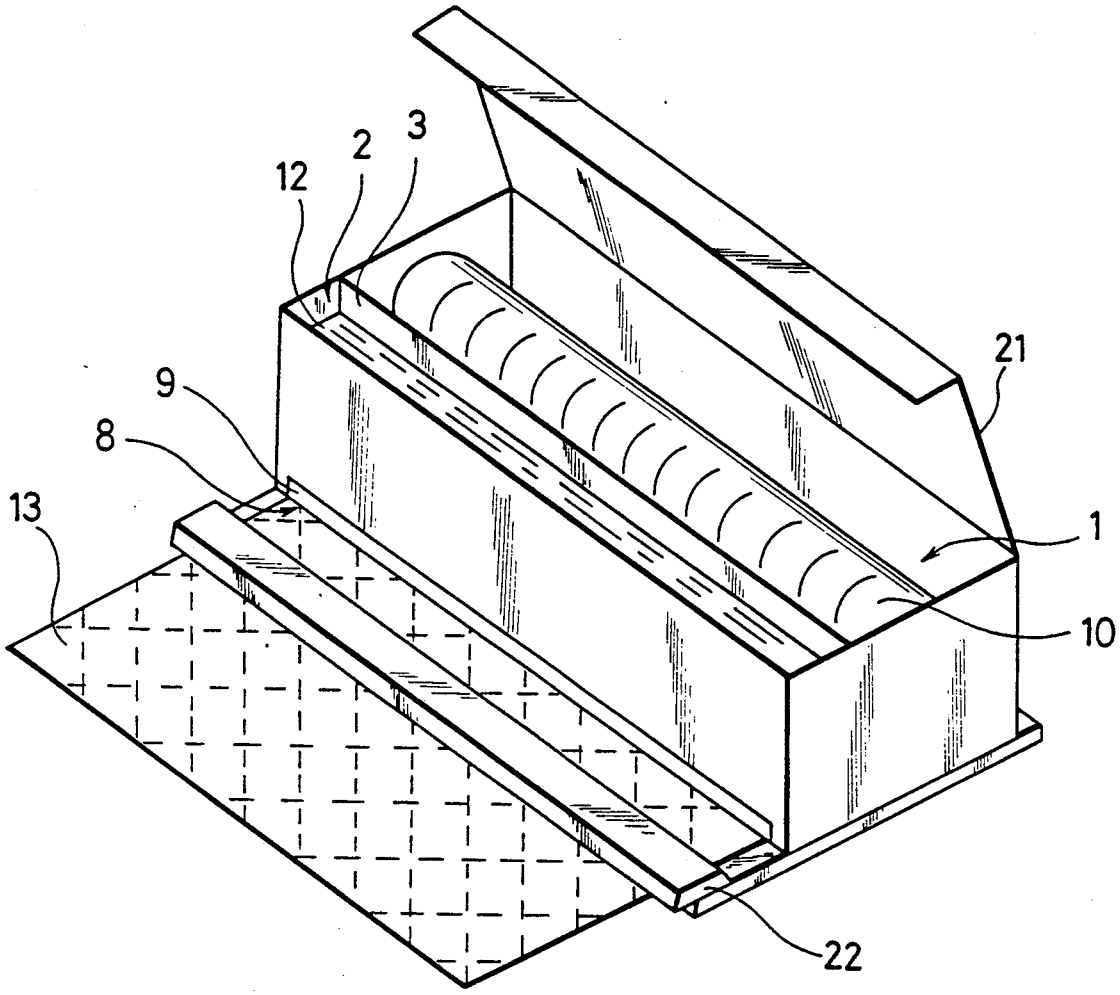
FIG. 6 is a perspective diagram of another example of the manually-operated sizing machine of the present invention.

FIG. 6 is perspective diagram of another example of a throwaway sizing machine according to the present invention. The boxshaped sizing machine with a cover (21) is pre-loaded with wall paper roll (10). The size with the amount necessary to size the wall paper is placed in the size container (2) sealed in a vinyl bag. When the machine is in use, the vinyl bag is opened to put the size (12) into the size container (2), providing sizing operations as with the similar procedures. In the example indicated in FIG. 6, a cutter (22) is provided, thereby facilitating the sized wall paper (13) to be cut to a desired length.

Descriptions will be given to a third example of the manually operated sizing machine according to the present invention.

In this example, a sheet pullout port (8) is provided with a cushion (23) in addition to a size cutter (9), with this cushion (23) pressed against the size cutter (9) at a constant pressure. For this reason, when the wall paper starts to be pulled out or when it ceases to be pulled out for a moment, the amount of size to adhered to the wall paper (13) can be made even. Since the sheet pullout port (8) is sealed because the size cutter (9) is pressed against the cushion (23), no size (12) will flow out of the sheet pullout port (8), for instance, when the wall paper (13) is cut. The materials for the cushion (23) can include sponge, felt, nonwoven cloth and other materials with restoring capability and elasticity.

Figure 7:
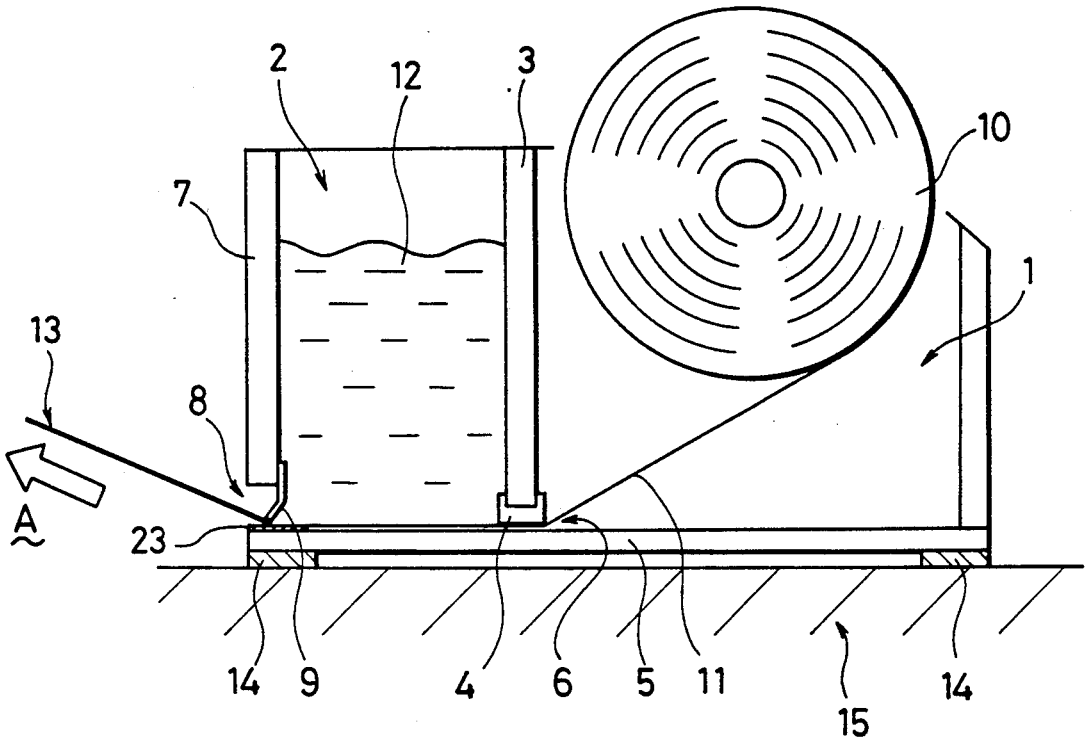
FIG. 7 is a vertical sectional view of a third example of the manually-operated sizing machine of the present invention.
Figure 8:
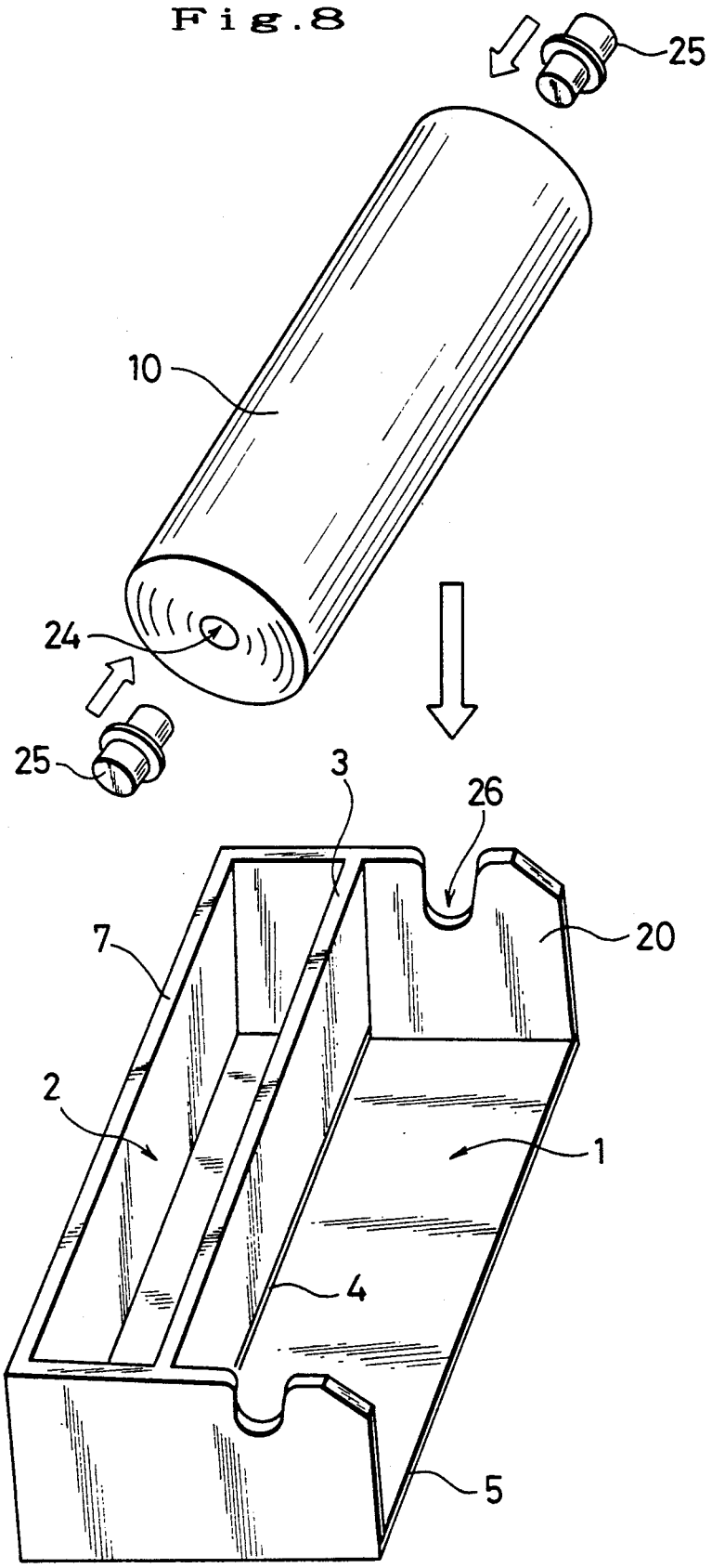
FIG. 8 is an exploded perspective view of one example of how to mount its sheet rolls.

Furthermore, in the case of the manually operated sizing machine as indicated in FIG. 7, a sheet roll (10) is mounted without any contact with the bottom plate (5) of a sheet roll unit (1). To mount the sheet roll (10) in such state, as indicated in FIG. 8, after suspending pins (25) are inserted and fixed at the ends of the bearing (24) at the center of the sheet roll (10), the suspending pins (25) are engaged in engagement grooves (26) in the side plates (20) of the sheet roll mount unit (1). The bottom of the engagement grooves (26) are semispherical shaped, and since the diameter is larger than that of the suspending pins (25), the suspending pins (25) can freely rotate on the engagement groove (20).

This facilitates the release of the sheet roll (10) and the pullout of the wall paper (13), and can prevent damage to the wall paper (11) since the surface of the wall paper (11) and the bottom plate (5) are not brought into contact with friction resistance.

It is to be understood that the invention is not limited in its application to the embodiments as described above, and that various other configurations may be made depending on the size and shape of a sizing machine, or the dimension and kind of sheet, and further the kind of a size cutter and size press.

As has been described in detail, the instant invention provides a compact and less expensive sizing machine which permits easy and even sizing on wall paper, floor sheet and other sheets and which does not cause any damage to the sheet.

What is claimed is:

1. A manually operated sizing machine comprising:

a bottom plate having two sides and first and second ends;

a pair of side plates affixed to said bottom plate at said sides thereof, respectively;

an end plate affixed to said side plates at said first end of said bottom plate having a space forming a pullout port between said end plate and said bottom plate;

a size cutter means positioned in said pullout port for setting an amount of size to be applied to sheet material;

a cushion material having elasticity and restoring capability provided at said pullout port between said bottom plate and a tip of said size cutter means, said cushion material for preventing size from flowing out of said pullout port, said size cutter means being provided with one of a sawtooth shaped tip and a waveform shaped tip, each having a height and a pitch which sets the amount of size to be adhered to sheet material;

a separation wall affixed to said side plates intermediate ends thereof forming therebetween a size container at said first end of said bottom plate and a sheet roll unit at said second end, said separation wall having a clearance between a bottom thereof and the bottom plate; and means in said sheet roll unit for rotatably supporting a roll of sheet material therein such that sheet material supported thereon and passing through said clearance of said separation wall and through said pullout port will be coated with size contained in said size container.

2. A machine as claimed in claim 1 wherein said supporting means comprises suspending pins to be inserted in the roll of sheet material, said pins being supported in the side plates at said sheet roll unit.

3. A machine as claimed in claim 1 further comprising size press means in the clearance at the bottom of said separation wall to prevent outflow of size from said size container.

* * * * *